US007604459B2

(12) United States Patent
Horng et al.

(10) Patent No.: US 7,604,459 B2
(45) Date of Patent: Oct. 20, 2009

(54) FAN FRAME STRUCTURE

(75) Inventors: Alex Horng, Kaohsiung (TW); Wen-Nan Chou, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 371 days.

(21) Appl. No.: 11/606,105

(22) Filed: Nov. 30, 2006

(65) Prior Publication Data

US 2008/0085818 A1 Apr. 10, 2008

(30) Foreign Application Priority Data

Sep. 4, 2006 (TW) ..... 95132528 A

(51) Int. Cl.
*F03B 11/02* (2006.01)

(52) U.S. Cl. ..... 415/214.1; 415/220

(58) Field of Classification Search ..... 415/196, 415/209.2, 213.1, 214.1, 215.1, 220

See application file for complete search history.

(56) References Cited

U.S. PATENT DOCUMENTS

2007/0231142 A1* 10/2007 Liu et al. ..... 416/189

* cited by examiner

*Primary Examiner*—Edward Look
*Assistant Examiner*—Dwayne J White
(74) *Attorney, Agent, or Firm*—Bacon & Thomas, PLLC

(57) ABSTRACT

The present invention relates to a fan frame structure, which is composed of a plastic seat and a metal circular casing. At least two opposing guard fences disposed in a radial manner and extended upwards from a top edge of said seat. A fitting rim for inserting the metal circular casing is provided between an inner surface of the guard fence and a top surface of the seat. A side column is extended from a top side of the guard fence to cover and support the metal circular casing. Accordingly, the use of costly metal material can be reduced to lower the production cost, and the decrease of strength and deformation of the fan frame structure due to high temperature can be prevented. Meanwhile, the frame wall thickness can be reduced to enlarge the fan blade, thereby increasing air flow, fan speed and heat dissipation performance of a cooling fan.

12 Claims, 7 Drawing Sheets

FAN FRAME STRUCTURE

FIELD OF THE INVENTION

The present invention relates to a fan frame structure, and more particularly to a structure that strength and heat resistance thereof can be improved to prevent the fan frame from being weakened in strength or deformed due to a high-temperature environment.

BACKGROUND OF THE INVENTION

As shown in FIG. 1, a conventional fan frame 10 has a hollow containing space 11 therein for accommodating a fan rotor (not shown), and a base 12 is disposed in the containing space 11. The base 12 is integrated with the fan frame 10 as a whole by means of a plurality of ribs 12, and a hole between the ribs 12 is formed as a passage for air circulation. A driving device (not shown, and the operation relationship of fan rotor and driving device is not covered here due to their irrelevance to the present invention) is mounted on the base 12 for driving the fan rotor to rotate and operate.

If classified by type of material, the conventional fan frame can be approximately classified into two types, namely type 1 pertaining to a die-casting aluminum frame and type 2 pertaining to an plastic frame produced by injection modeling.

Due to higher material cost itself, the die-casting aluminum frame costs relatively more.

Although the material cost is relatively cheaper than the aluminum frame, the plastic frame produced by injection modeling has its intrinsic material issue, making the plastic frame hardly a substitution for the aluminum frame.

Here are some disadvantages of the plastic frame to be concluded and depicted in details.

(1) Uncontrollable dimension precision: In a cooling process after injection modeling of plastic frame, if the saturation pressure condition is not controlled well, the material is often prone to contraction and is thus subjected to an inferior dimension precision of the finished product.

(2) Inferior structure strength and heat resistance: As a result of inferior heat resistance and deteriorating strength of the plastic material at high temperature, the plastic fan frame is often deformed to further result in attrition between the rotating fan rotor and the fan frame from which the quality issues usually come, while the plastic frame is operated in a high-temperature environment.

(3) Confined development and design space: In consideration of the quality, the plastic frame usually maintains a fixed wall thickness to secure the overall strength of the fan frame, meaning that R & D people must give priority to reserve room for the wall thickness of the fan frame and the gap between the frame and the fan rotor while dealing with smaller cooling fan, and in turn indicating that the blade size of fan rotor shall be reduced. However, the blade size further directly relates to the overall heat dissipation performance of the cooling fan. As a consequence, the cooling fan designed and developed in such manner fails to effectively and obviously surpass its current performance.

(4) Limited cooling fan performance: When the blade size of the fan rotor is subjected to limitation, the air flow and fan speed of the cooling fan are also constrained so as to introduce a deficit to the entire performance.

As such, to completely tackle the inherent issue of the aforementioned fan frame, a fan frame structure with brand new idea shall be more aggressively conceived and developed to enhance its overall structure strength and heat resistance, and the structure strength decrease and deformation issues arising from a high-temperature environment are effectively prevented.

SUMMARY OF THE INVENTION

In view of the foregoing concern, the present invention thus provides a fan frame structure including a seat and a metal circular casing. The seat is made of a plastic material and has a hollow containing space therein and is provided with a base, in which the base is integrated with the seat as a whole by means of a plurality of ribs, and a driving device and a fan rotor are disposed on the base. The metal circular casing is made of a metal material, provides a hollow containing space corresponding to the seat and is tightly integrated with the seat as a whole. The seat and the metal circular casing are optimally combined by burying the metal circular casing in the seat and simultaneously performing injection modeling of the seat and the metal circular casing, such that a guard fence is extended upwards from each of four corners on the top surface of the seat to cover and support the metal circular casing, a fitting rim is formed between an inner surface of the guard fence and the top surface of the seat for the metal circular casing to be inserted, a side column is extended from a top side of the guard fence, and a fixing hole is provided on the side column for a device to be fastened in a heat dissipation location.

By means of the design concept of a fan frame composed of a plastic seat and a metal circular casing, the present invention reduces the use of costly metal material on the one hand to lower the manufacturing cost and sufficiently makes the most of high strength and high heat resistance characteristics of the material of the metal circular casing to prevent the strength decrease and deformation resulting from high temperature in the manufacturing process of the fan frame or from a high-temperature environment. Moreover, in contrast to conventional plastic frame, the metal circular casing is designed to have a wall thickness of the frame that is greatly reduced in size and harmless to its structure strength. As far as a small-scale cooling fan is concerned, an additional 1 mm space of the outer diameter of the fan blade is gained for each 1 mm reduction of the wall thickness. The most direct outcome is the increase of the air flow, fan speed and heat dissipation performance, thereby making the development and design of the cooling fan head for a faster and more efficient heat dissipation domain.

DETAILED DESCRIPTION OF THE PREFERRED EMBODIMENT

The present invention relates to a fan frame structure, which is composed of a plastic seat and a metal circular casing. Given the structure, on the one hand, the use of expensive metal material can be reduced, and on the other hand, the intrinsic high strength and high heat resistance of the metal circular casing can be sufficiently explored to prevent the decrease of strength and deformation arising from high temperature in the manufacturing process of the fan frame or from a high-temperature environment.

Figure 1:
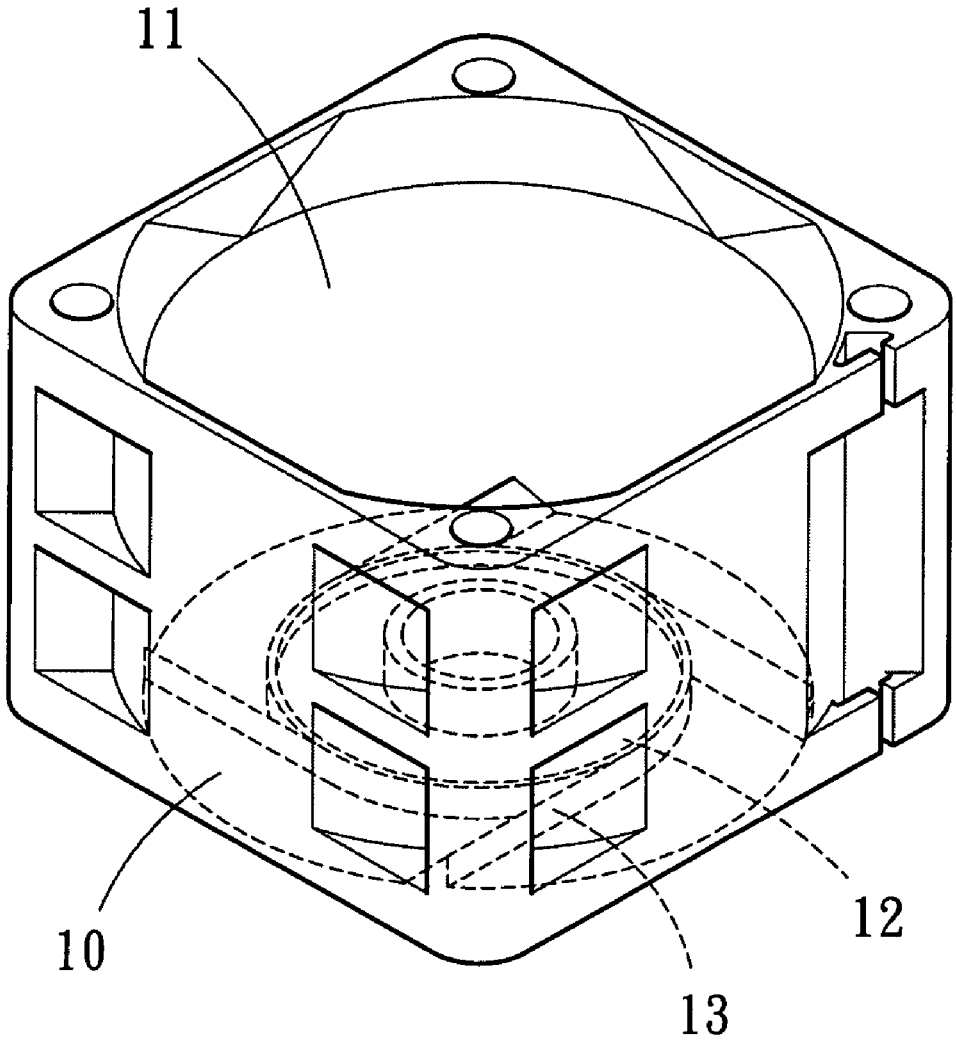
FIG. 1 is a 3D exterior view showing a conventional fan frame structure.
Figure 2:
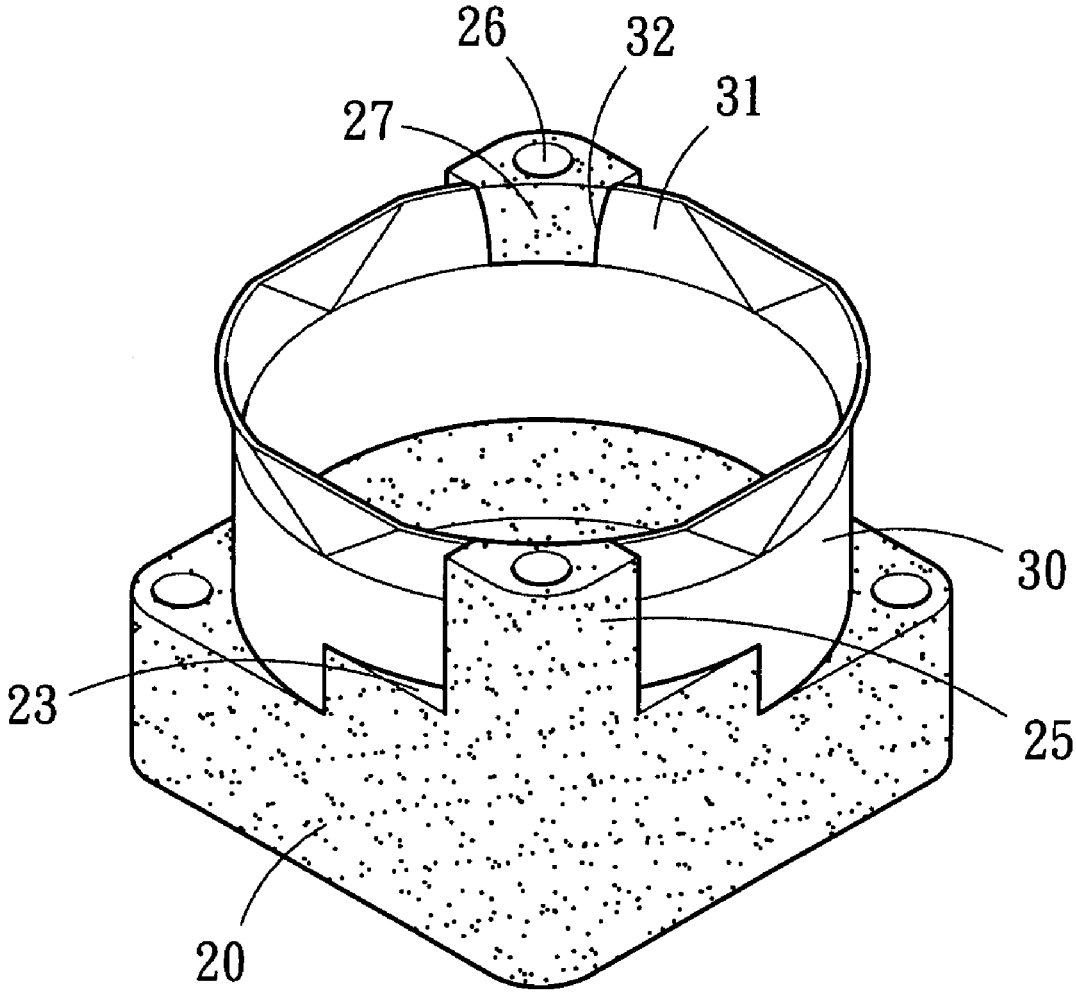
FIG. 2 is a 3D exterior view showing a first preferred embodiment.
Figure 3:
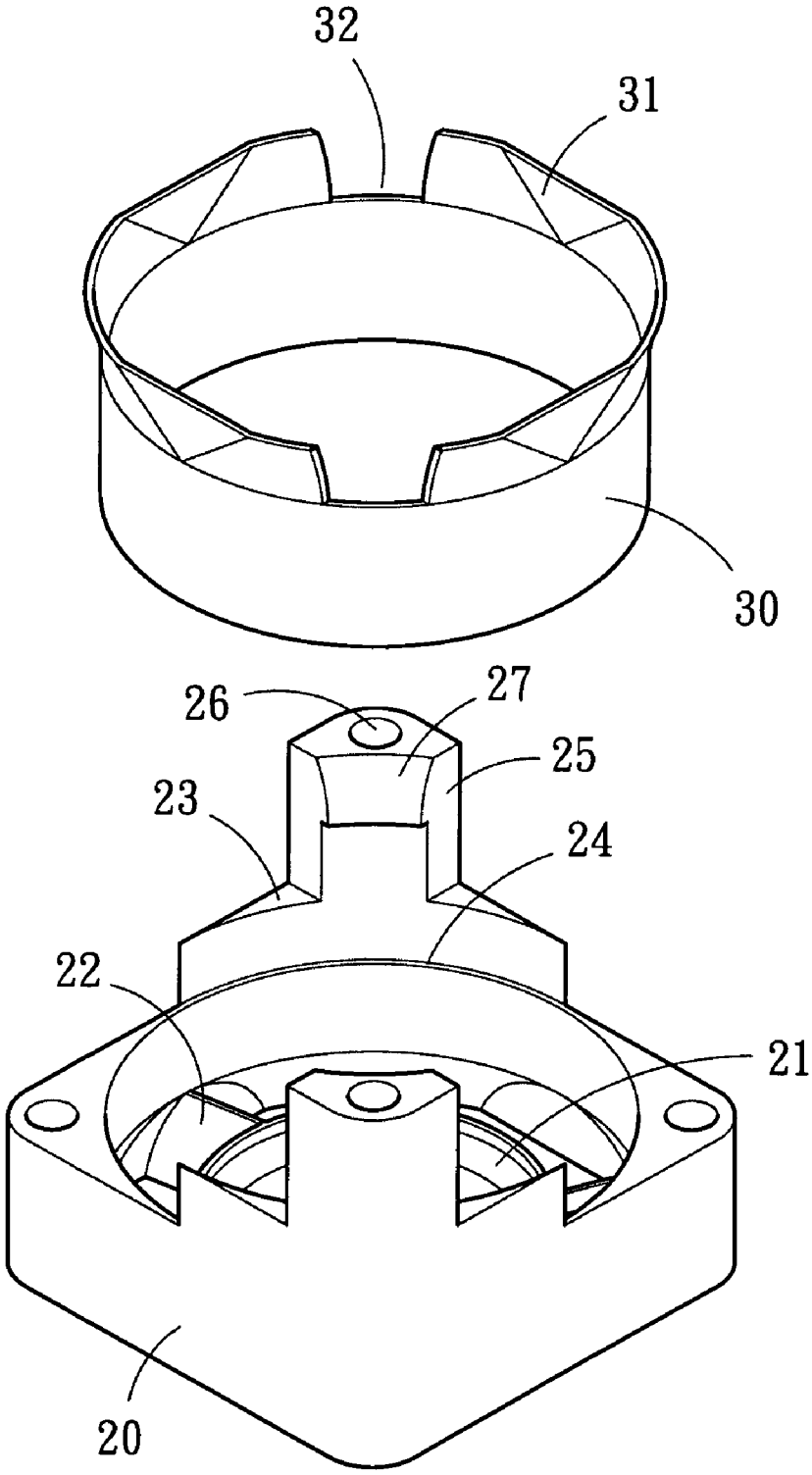
FIG. 3 is a fictitious exploded view showing a first preferred embodiment.

Here are some preferred embodiments of the present invention for illustration. As shown in FIG. 2 and FIG. 3, a first preferred embodiment of the present invention includes a plastic seat 20 and a metal circular casing 30. The seat 20 is a frame having a hollow containing space therein and has a base 21 disposed therein. The base 21 is integrally integrated with the seat 20 by means of a plurality of ribs 22, and a hole between the ribs 22 serves as a passage for air flow circulation. A driving device and a fan rotor are disposed on the base 21, and the driving device is used to drive the fan rotor to rotate and operate for achieving effect of heat dissipation. At least two opposing guard fences 23 disposed in a radial manner are extended upwards from the top side of the seat 20 so as to from a fitting rim 24 between the inner surface and the top surface of the seat 20. Besides, a side column 25 is disposed on top of the guard fence 25 and is penetrated through by a fixing hole 26.

The metal circular casing corresponds to the containing space of the seat 20 and is inserted in the fitting rim 24. By supporting and positioning with the guard fence 23 and the side column 25, the metal circular casing is tightly coupled with the seat 20.

The seat 20 and the metal circular casing 30 can be coupled with a locking pawl for mutual engagement and can be integrated together by a tight coupling. Alternatively, the metal circular casing is buried in the mold of the seat 20 and is integrally formed therewith in the injection modeling process.

What the preferred embodiment discloses is to simultaneously bury the metal circular casing 30 in the seat 20 in the injection modeling process of the seat 20. As a result, what FIG. 3 shows is a fictitious exploded view. In reality, after the metal circular casing 30 is buried in the seat 20, both cannot be decomposed with a non-destructive means.

A circular inclination surface 31 that expands outwards is formed on the top edge of the metal circular casing 30 to increase the air inlet area of the fan frame and rises up to align with the top surface of the side column 25. An inner surface of the side column 25 of the seat 20 is also formed with a bevel 27 to correspond to the circular inclination surface. Moreover, the metal circular casing 30 has more than one notches 32 formed on the top edge thereof, and each notch correspond to the position of each respective side column 25. Therefore, when the metal circular casing 30 is buried in the seat 20 and is modeled and injected together, the material is filled in the space of the notches 32 to generate a mutual engagement effect similar to that provided by the locking pawl and thus integrate the metal circular casing 30 and the seat 20 together.

Accordingly, the design concept of the present invention combining the plastic seat 20 with the metal circular casing 30 can reduce the use of costly metal material to lower the production cost on the one hand and fully explore the characteristics of high strength and high heat resistance to prevent the decrease of strength and deformation arising from high temperature in the manufacturing process of the fan frame or from a high-temperature environment on the other hand. In addition, the metal circular casing 30 can be made with significantly reduced wall thickness of the fan frame that is harmless to its structure strength. When specifically speaking of smaller cooling fan, the external diameter of the blade of the fan rotor can be enlarged 1 mm for each 1 mm wall thickness reduction of the fan frame. The most influential aspect lies in the increase of air flow, fan speed and heat dissipation performance of the cooling fan. When the fan frame can be really thin in size, the development and design thereof are no longer subjected to the constraint and can naturally innovate, break through and challenge faster and more effective heat dissipation domain.

Figure 4:
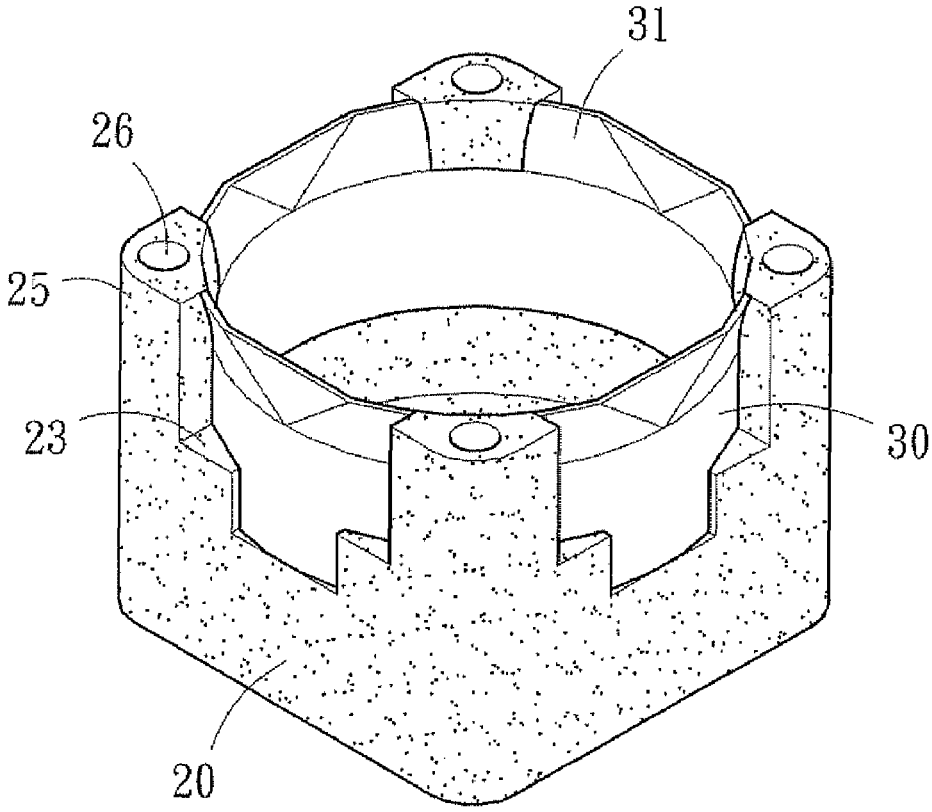
FIG. 4 is a 3D exterior view showing a second preferred embodiment.
Figure 5:
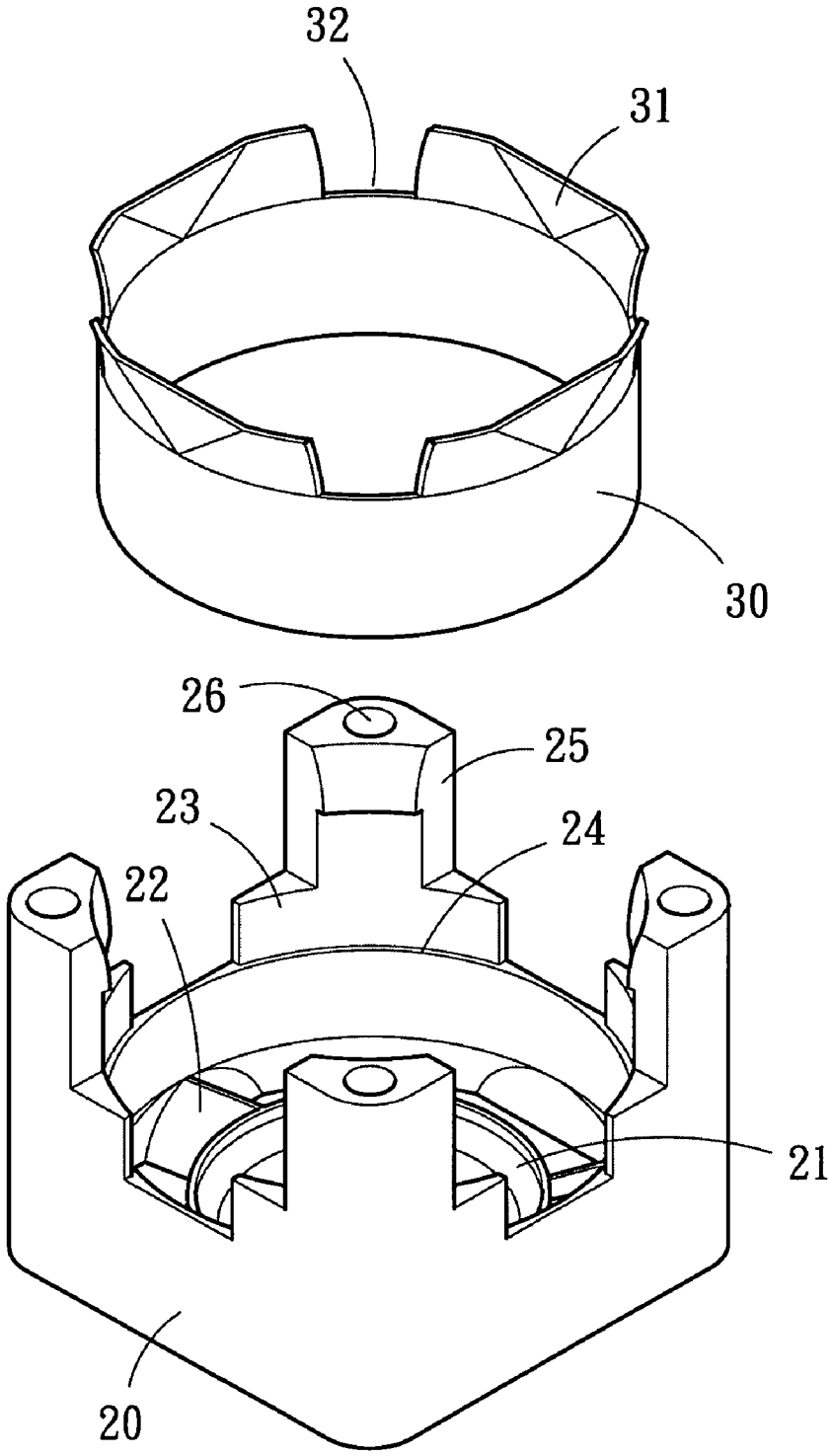
FIG. 5 is a fictitious exploded view showing a second preferred embodiment.

What FIG. 4 and FIG. 5 show is a second preferred embodiment of the present invention. A guard fence 23 is extended upwards from each of the four corners on top edge of the seat 20 such that a fitting rim 24 is formed between the inner surface of the guard fence 23 and the top surface of the seat 20 for insertion of the metal circular casing 30.

Similarly, the top edge of the metal circular casing 30 in the preferred embodiment is equipped with more than one notches 32, and each notch correspond to the position of the respective side column 25. As such, when the metal circular casing 30 is buried, modeled and injected by a mold of the seat 20, the material is filled in the space of the notches 32 to form a mutual engagement effect similar to that provided by the locking pawl and the metal circular casing 30 and the seat 20 are integrally integrated together.

Figure 6:
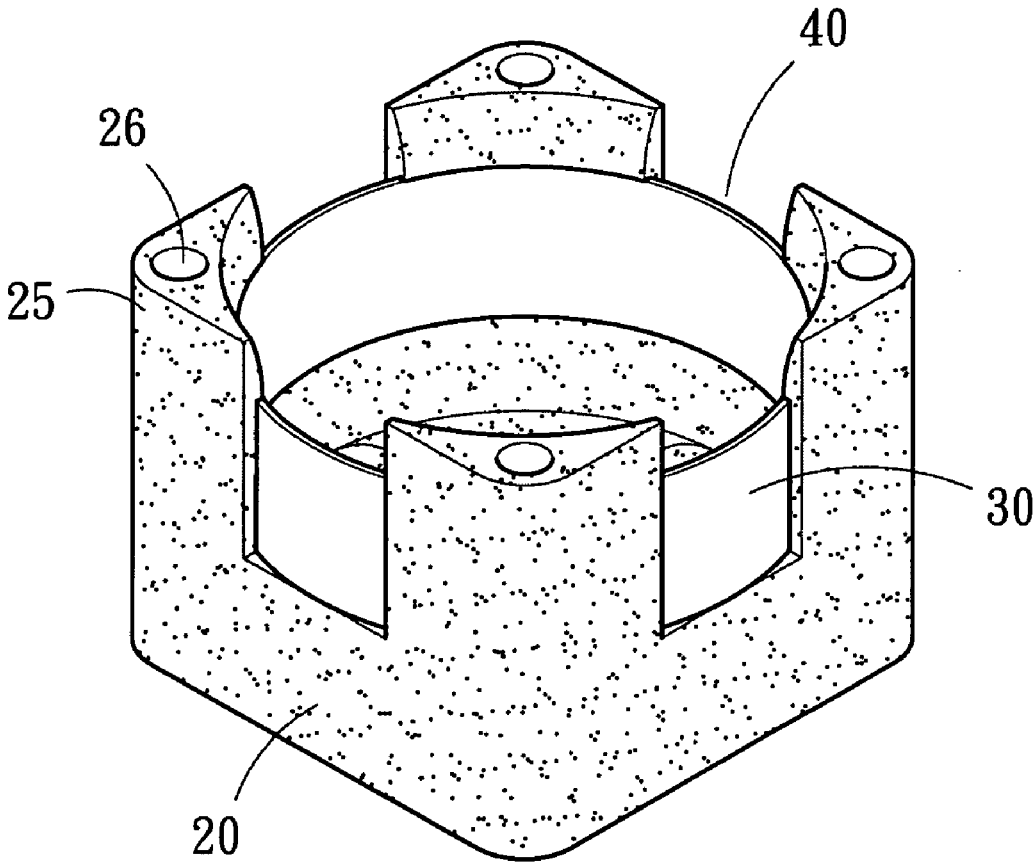
FIG. 6 is a 3D exterior view showing a third preferred embodiment.
Figure 7:
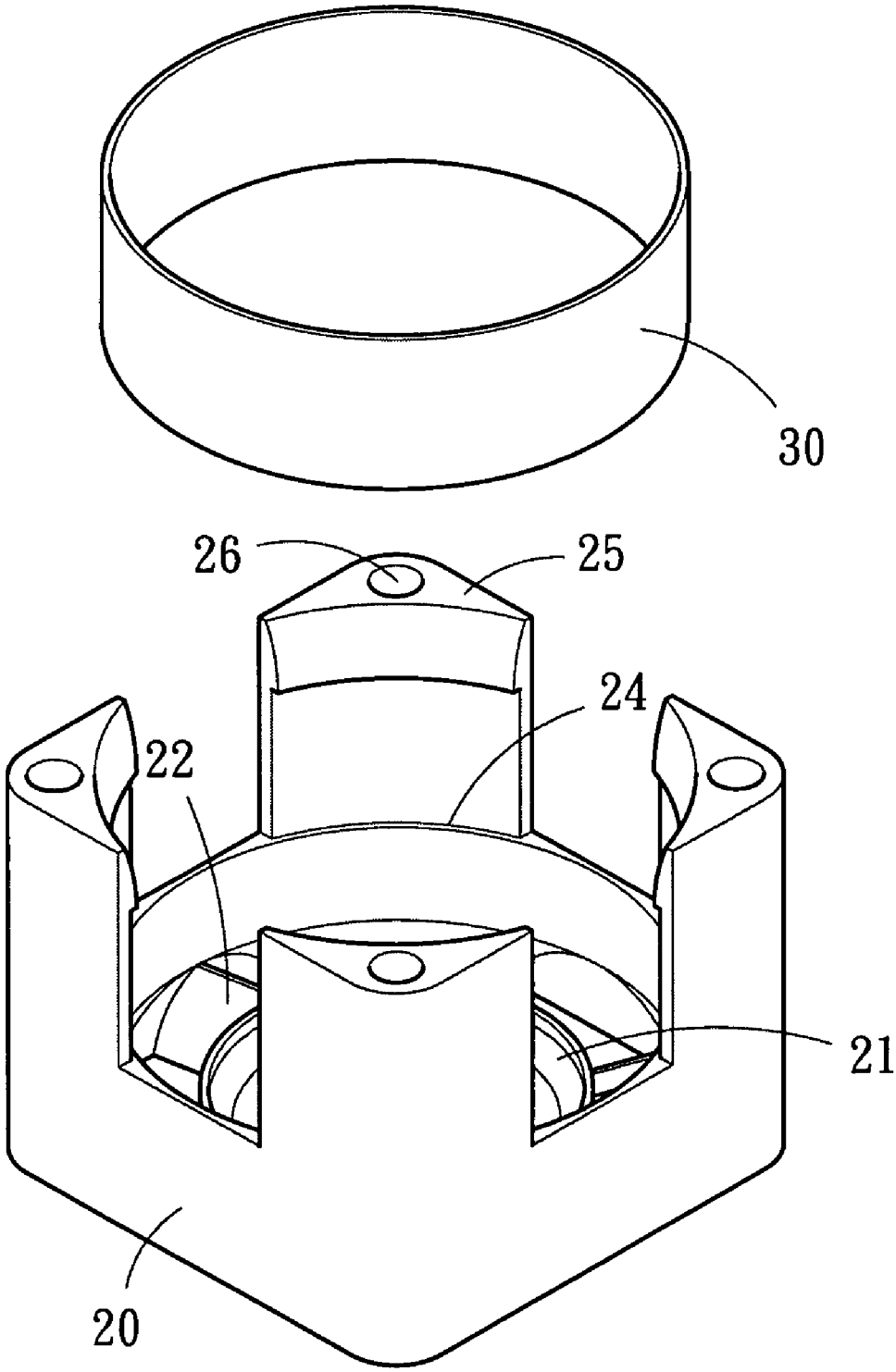
FIG. 7 is a fictitious exploded view showing a third preferred embodiment.

What FIG. 6 and FIG. 7 show is a third preferred embodiment of the present invention. Similarly, in the preferred embodiment the metal circular casing 30 is simultaneously buried in the seat 20 and integrally integrated therewith during the injection modeling process of the seat 20. Hence, FIG. 7 is a fictitious exploded view as well.

The metal circular casing 30 in the preferred embodiment has no design of circular inclination surface 31 on the top edge thereof. Besides, the height of the metal circular casing 30 is no more than the height of the top surface of the side column 25. Consequently, after the metal circular casing 30 is buried in the seat 20 and is modeled and injected, an air inlet 40 is formed between two side columns on the tope edge of the metal circular casing 30 to increase the air supply rate of the fan frame.

In sum, when comparing the fan frame structure of the present invention with the aforementioned conventional structure, it is understood that the characteristics of the present invention at least include:

(1) Low production cost and inexpensive price: The present invention employs a design concept that combines a plastic seat and a metal circular casing into a fan frame to reduce the use of costly metal material and lower the production cost, so as to lower the price of the finished product to promote the competitive edge in the market at the same time.

(2) Compliance with size precision requirement of fan frame: As the seat portion is located at the lower part of the fan frame, the dimension precision is not subjected to strict requirement in general. In that sense, the present invention selects plastic material for the making of the seat and further select metal circular casing as the surrounding wall body of the fan frame to comply with the dimension precision requirement of the fan frame.

(3) Improved overall structure strength and heat resistance: Owing to the characteristics of high strength and heat resistance of the material itself of the metal circular casing, the decrease of strength and deformation caused by high temperature in the production process of the fan frame or from a high-temperature environment can be prevented.

(4) More room for development and design: In contrast to the wall thickness of plastic frame, the metal circular casing of the present invention can be truly thin in size, thereby making the development and design free from the conventional spatial limitations and naturally head for a faster and more efficient heat dissipation field.

(5) Improved cooling fan performance: The present invention employs a design combining the seat and the metal circular casing to truly achieve a thin wall thickness of the cooling fan. As far as a smaller cooling fan is specifically concerned, the extra space resulting from thinner wall thickness of the fan frame can be allocated for larger size of the fan blade, which directly results in the enhancement of air flow, fan speed and heat dissipation performance. From the above-mentioned characteristics those features not only has a novelty among similar products and a progressiveness, but also has an industry utility While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A fan frame structure, comprising:

a seat made of a plastic material, having a hollow containing space therein, and equipped with a base integrally integrated with said seat by means of a plurality of ribs, and a driving device and a fan rotor disposed on said base; and a metal circular casing made of a metal material, corresponding to said hollow containing space of said seat, and tightly combined with said seat;

wherein at least two corresponding guard fences are disposed in a radial manner and extended upwards from a top edge of said seat, a fitting rim for said metal circular casing to be inserted is formed between an inner surface of each of said guard fences and a top surface of said seat, and a side wall is extended from a top surface of each of said guard fences and has a fixing hole disposed thereon.

2. The fan frame structure of claim 1, wherein said guard fences are extended from two diagonal corners on said top surface of said seat.

3. The fan frame structure of claim 1, wherein said guard fences are extended from four corners on said top surface of said seat.

4. The fan frame structure of claim 1, wherein a circular inclination surface being expanded outwards is formed on a top edge of said metal circular casing.

5. The fan frame structure of claim 4, wherein a top surface of said circular inclination surface aligns with a top surface of said side column, and a bevel is formed on an inner surface of said side column corresponding to said circular inclination surface.

6. The fan frame structure of claim 1, wherein said seat and said metal circular casing are mutually engaged with a locking pawl mechanism.

7. The fan frame structure of claim 1, wherein said seat and said metal circular casing are integrally integrated by a tight coupling.

8. The fan frame structure of claim 1, wherein said metal circular casing is simultaneously buried in said seat in an injection modeling process of said seat and is modeled and injected together with said seat.

9. The fan frame structure of claim 1, wherein said metal circular casing has a plurality of notches on a top edge thereof and each notch corresponds to a position of said respective side column, a material is filled in said notches to form an engagement effect as provided by a locking pawl mechanism during an injection modeling process for integrally forming said seat and said metal circular casing.

10. The fan frame structure of claim 1, wherein a top edge of said metal circular casing is slightly lower than a top surface of said side column such that an air inlet is formed between said top edge of said metal circular casing and each of two side columns to increase an air supply rate after an injection modeling process for integrally forming said seat and said metal circular casing is performed.

11. A fan frame structure, comprising:

a seat made of a plastic material, having a hollow containing space therein, and equipped with a base integrally integrated with said scat by means of a plurality of ribs, and a driving device and a fan rotor disposed on said base; and a metal circular casing made of a metal material, corresponding to said hollow containing space of said seat, and tightly combined with said seat;

wherein a circular inclination surface being expanded outwards is formed on a top edge of said metal circular casing.

12. The fan frame structure of claim 11, wherein a top surface of said circular inclination surface aligns with a top surface of said side column, and a bevel is formed on an inner surface of said side column corresponding to said circular inclination surface.

* * * * *